US005971102A

United States Patent [19]

Brown

[11] Patent Number: 5,971,102

[45] Date of Patent: Oct. 26, 1999

[54] LADDER INCLUDING STORAGE COMPARTMENTS

[76] Inventor: Norma Brown, 2721 Kings Hwy. apt. 4M, Brooklyn, N.Y. 11229

[21] Appl. No.: 09/134,958

[22] Filed: Aug. 17, 1998

[51] Int. Cl.[6] ..... E04G 1/00

[52] U.S. Cl. ..... 182/129; 206/372

[58] Field of Search ..... 182/129, 108, 182/111; 248/210, 238; 206/372, 373; 340/323 R; 385/13

[56] References Cited

U.S. PATENT DOCUMENTS

| | | | |
|---|---|---|---|
| 2,563,436 | 8/1951 | Toth | 182/33.5 |
| 3,842,936 | 10/1974 | De Luca | 182/129 |
| 4,683,982 | 8/1987 | Baker | 182/111 X |
| 5,031,723 | 7/1991 | Hooten | 182/129 |
| 5,193,129 | 3/1993 | Kramer | 385/13 |
| 5,339,956 | 8/1994 | Thomason | 206/372 |
| 5,500,635 | 3/1996 | Mott | 340/323 R |
| 5,505,302 | 4/1996 | Ferley | 206/373 |
| 5,547,080 | 8/1996 | Klimas . | |
| 5,603,405 | 2/1997 | Smith . | |
| 5,613,574 | 3/1997 | Melanson . | |
| 5,873,463 | 2/1999 | Purcell | 206/372 |

*Primary Examiner*—Daniel P. Stodola
*Assistant Examiner*—Hugh B. Thompson
*Attorney, Agent, or Firm*—Michael I. Kroll

[57] ABSTRACT

A ladder including storage areas for allowing access to an area out of reach of a user. A tool box is removably connected at a top end of the ladder so as to be easily accesible to a user of the ladder. The ladder includes a first pair of legs and a second pair of legs extending at an adjustable angle to the first pair of legs. A plurality of steps extend between the legs of the first pair of legs and a storage compartments is positioned below each of the plurality of steps. The storage compartments are each movable between a first position completely contained beneath its respective step and a second position extending out from its respective step providing access to a storage area. Adjustable feet positioned on a base side of each leg of the ladder. The adjustable feet are both angularly adjustable and height adjustable to adapt the ladder to the terrain on which it is to sit. A pressure sensitive alarm is positioned to generate an audible alarm when a user applies pressure to the bottom step. A retaining device is also provided adjacent the work area for retaining a tool or supply necessary for the user in an easily accessible location. Alternatively, an alternate workpiece such as a paint tray may be releasably connected at the position of the toolbox.

30 Claims, 15 Drawing Sheets

Fig. 2
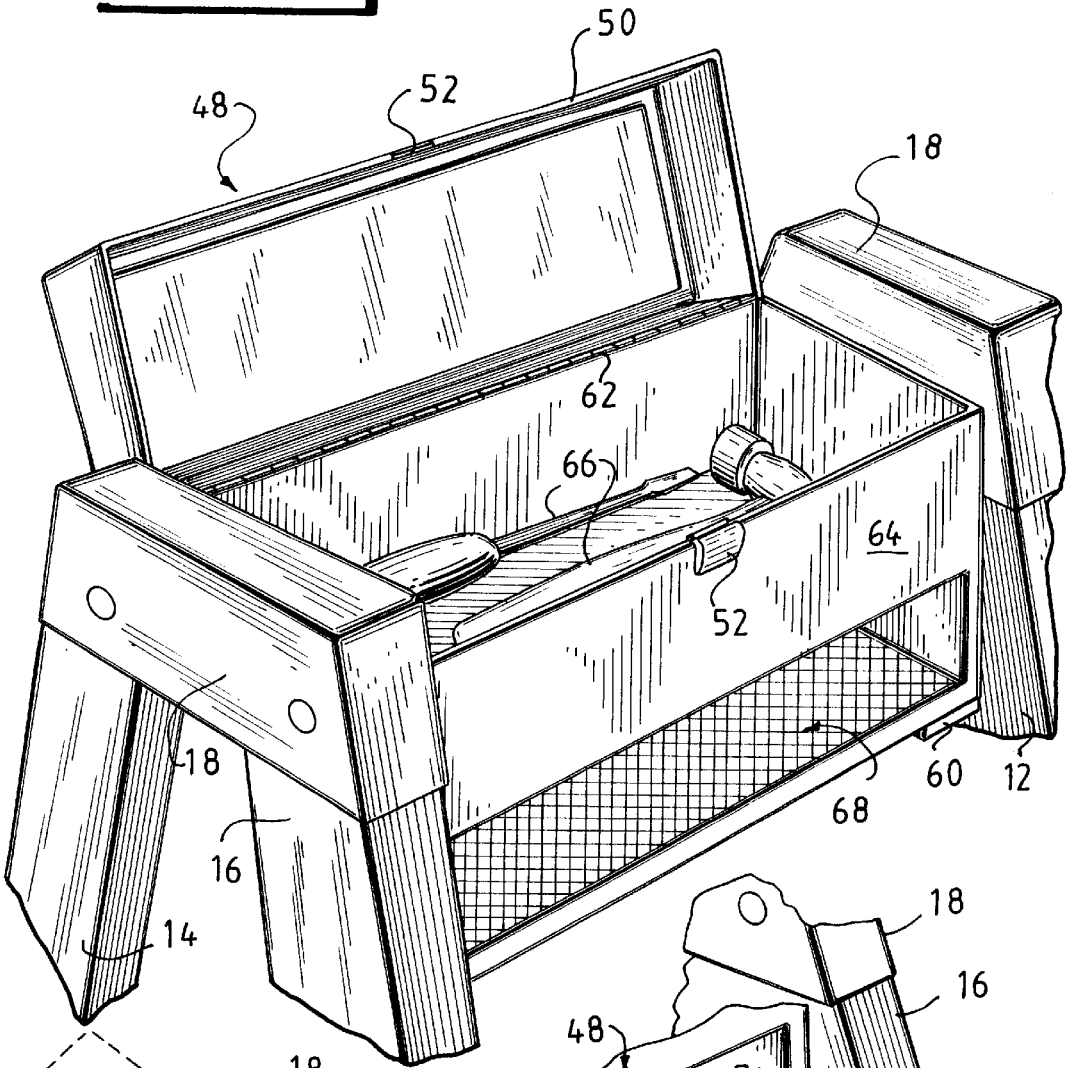
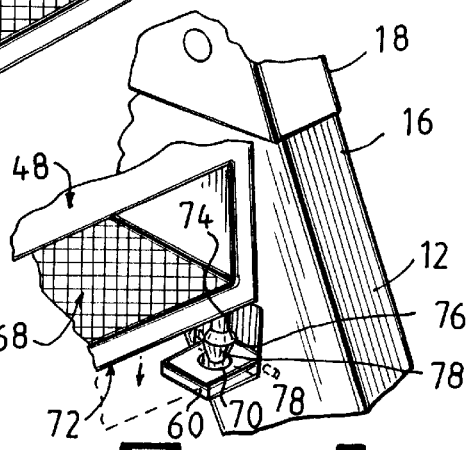
Fig. 3
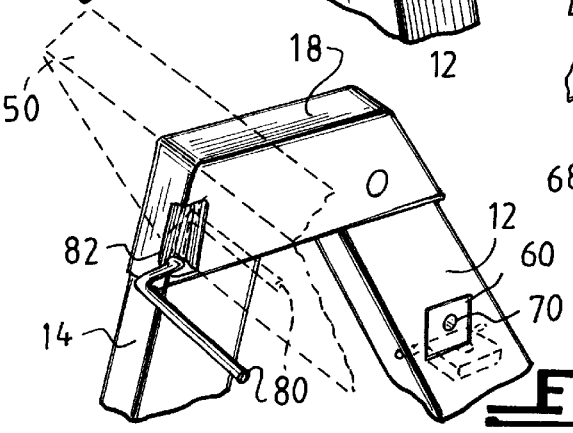
Fig 4

18
82
18
12
60
12
82
80
86
14
14
22
84
22
24
38
40
24
44
14
42

LADDER INCLUDING STORAGE COMPARTMENTS

BACKGROUND OF THE INVENTION

1. Field of the Invention

The present invention relates generally to ladders and, more specifically, to a ladder able to retain a toolbox in a strategically located position adjacent the work area, the ladder including hideaway storage cabinets and a device for retaining a tool required for the particular job being performed in a position adjacent and easily accessible to the user.

2. Description of the Prior Art

Numerous types of ladders have been provided in the prior art. For example, U.S. Pat. Nos. 5,505,302; 5,547,080; 5,603,405 and 5,613,574 all are illustrative of such prior art. While these units may be suitable for the particular purpose to which they address, they would not be as suitable for the purposes of the present invention as heretofore described.

U.S. Pat. No. 5,505,302

Inventor: Scott R. Ferley

Issued: Apr. 9, 1996

A toolbox for a stepladder comprising a container having a holding space therein, a scalable opening for selectively allowing and preventing access to the holding space, and an outwardly extending lip adapted for hanging items thereupon; and a coupling mechanism for coupling the container to a stepladder.

U.S. Pat. No. 5,547,080

Inventor: Joseph J. Klimas

Issued: Aug. 20, 1996

The invention relates to a tool box that has a lid that may be unobstructedly opened while the box is suspended by its own hanger from a horizontal member of a scaffold. Moreover, the tool box is designed to block rotation of the box while suspended, so that it may be opened, closed, and accessed while remaining out of the way in its hanging position on the scaffold.

U.S. Pat. No. 5,603,405

Inventor: William H. Smith

Issued: Feb. 18, 1997

A ladder top storage rack includes a rigid tool box securable to a ladder top. A pair of side pouches are secured to two side walls of the tool box. Each of the side pouches has a zippered opening. A rear pouch is secured to the rear wall of the tool box. The rear pouch has a zippered opening.

U.S. Pat. No. 5,613,574

Inventor: Charles J. Melanson

Issued: Mar. 25, 1997

A combined compartmented tray and tool holster is arranged to removably clamp onto the top step of a stepladder. The tool holster presents the tool to one side of the ladder or the other as desired. An opening at the bottom of the holster permits passage therethrough of the end of the tool with any tool bit attached thereto. The tool handle rests securely in ready reach of the worker without fear of dropping the tool, while both hands are free when required. Items in the compartments are also within case reach and view of the worker. The clamping system for clamping the device to the top step is adjustable to steps of various thicknesses.

SUMMARY OF THE PRESENT INVENTION

The present invention relates generally to ladders and, more specifically, to a ladder able to retain a toolbox in a strategically located position adjacent the work area, the ladder including hideaway storage cabinets and a device for retaining a tool required for the particular job being performed in a position adjacent and easily accessible to the user.

A primary object of the present invention is to provide a ladder including storage areas that will overcome the shortcomings of prior art devices.

Another object of the present invention is to provide a ladder including storage areas which is able to retain a desired tool in an easily accessible position adjacent the user.

A further object of the present invention is to provide a ladder including storage areas which is able to store numerous tools and other desired items in storage cabinets positioned so as not to obstruct the user.

A yet further object of the present invention is to provide a ladder including storage areas wherein the storage cabinets are in the form of pull out drawers located beneath the steps of the ladder and including a snap lock to lock the storage cabinets in place upon return to a position beneath its respective step.

A still further object of the present invention is to provide a ladder including storage areas wherein the tool box is removably positioned within the work area defined by the ladder.

A further object of the present invention is to provide a ladder including storage areas having an alarm signal indicating when the user has reached the bottom step thereby preventing the possibility of the user stumbling when descending from the ladder.

A further object of the present invention is to provide a ladder including storage areas wherein the alarm signal is generated by a pressure sensor positioned in the bottom step and activated when a user applies a pressure to the step such as by stepping thereon.

Another object of the present invention is to provide a ladder including storage areas having adjustable feet on a base of the legs of the ladder thereby adding stability to the ladder when in use. The feet being both angularly and height adjustable.

An even further object of the present invention is to provide a ladder including storage areas wherein a paint tray or storage tray may be releasably connected atop the ladder and within the work area of the user in lieu of the toolbox.

A yet further object of the present invention is to provide a ladder including storage areas including a toolbox releasably positioned within the work area of the user, the toolbox being designed to retain and store supplies and tools related to the particular job to be performed.

A still further object of the present invention is to provide a ladder including storage areas that is simple and easy to use.

A still further object of the present invention is to provide a ladder including storage areas that is economical in cost to manufacture.

Additional objects of the present invention will appear as the description proceeds.

A a ladder including storage areas for allowing access to an area out of reach of a user is disclosed by the present invention. A tool box is removably connected at a top end of the ladder so as to be easily accesible to a user of the ladder. The ladder includes a first pair of legs and a second pair of legs extending at an adjustable angle to the first pair of legs. A plurality of steps extend between the legs of the first pair of legs and a storage compartments is positioned below each of the plurality of steps. The storage compartments are each movable between a first position completely contained beneath its respective step and a second position extending out from its respective step providing access to a storage area. Adjustable feet positioned on a base side of each leg of the ladder. The adjustable feet are both angularly adjustable and height adjustable to adapt the ladder to the terrain on which it is to sit. A pressure sensitive alarm is positioned to generate an audible alarm when a user applies pressure to the bottom step. A retaining device is also provided adjacent the work area for retaining a tool or supply necessary for the user in an easily accessible location. Alternatively, an alternate workpiece such as a paint tray may be releasably connected at the position of the toolbox.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

FIG. 2 is an enlarged top perspective view of a first embodiment of the tool box positioned in the work area on the ladder of the toolbox releasably connected to the ladder including storage areas of the present invention;

FIG. 3 is an enlarged top perspective view of the releasable connection between the tool box and top step of the ladder of the toolbox releasably connected to the ladder including storage areas of the present invention;

FIG. 4 is a enlarged top perspective view of a retaining device connected to the ladder of the toolbox releasably connected to the ladder including storage areas of the present invention, a retracted position of the retaining device and open top of the tool box are illustrated in dashed lines;

DESCRIPTION OF THE REFERENCED NUMERALS

Figure 1:
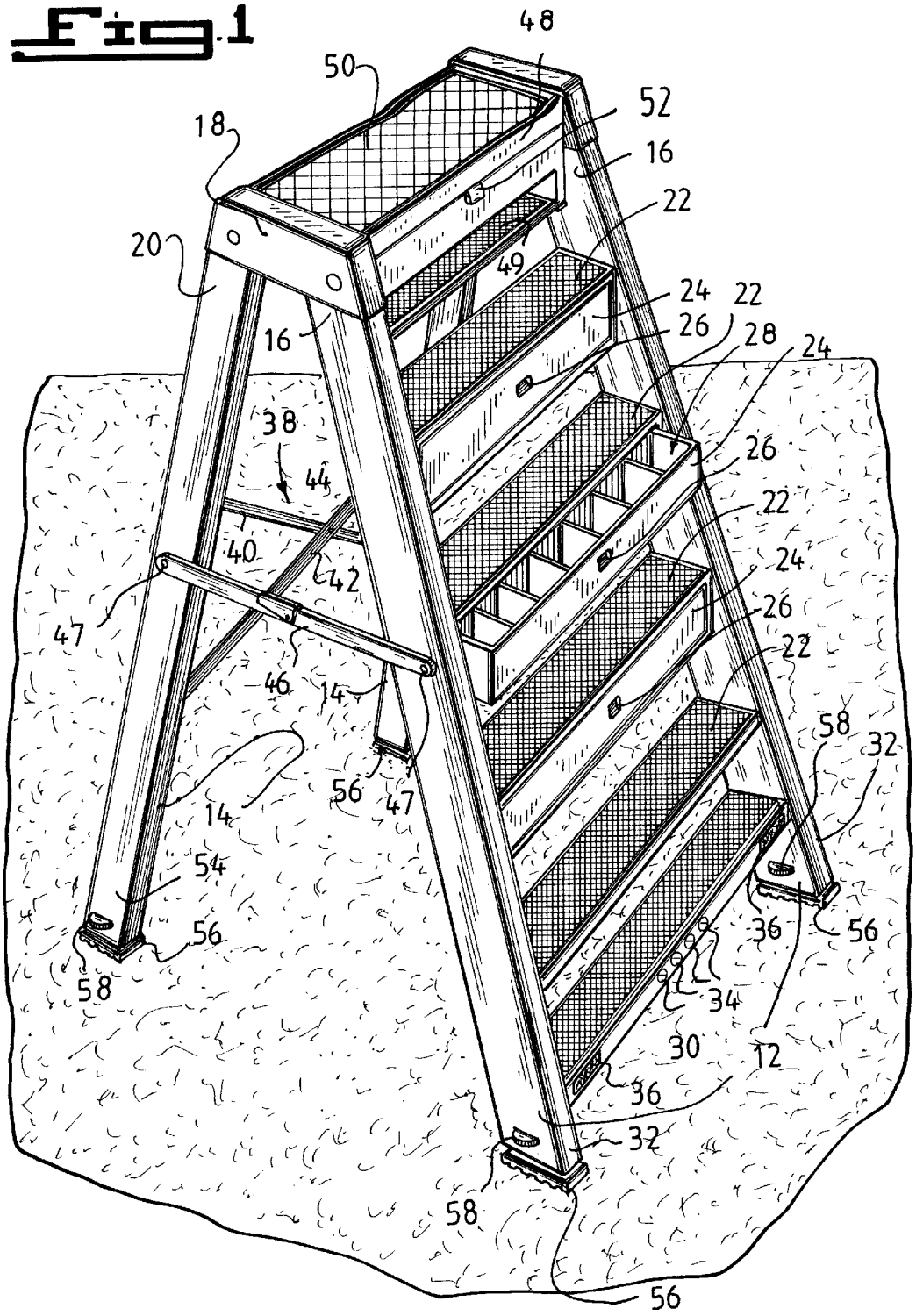
FIG. 1 is a top perspective view of the toolbox releasably connected to the ladder including storage areas of the present invention.

Turning now descriptively to the drawings, in which similar reference characters denote similar elements throughout the several views, the Figures illustrate the ladder including storage areas of the present invention. With regard to the reference numerals used, the following numbering is used throughout the various drawing figures.

10 ladder including storage areas of the present invention

12 first pair of legs

14 second pair of legs

16 first end of legs of first pair of legs

18 top step

20 first end of legs of second pair of legs

22 plurality of steps

24 plurality of drawers
26 latch on drawer
28 compartments for retaining tools within drawer
30 bottom step
32 second end of the legs of the first pair of legs
34 power source
36 audible alarm
38 stabilizing device
40 first cross bar of stabilizing device
42 second cross bar of stabilizing device
44 connection point of first and second cross bars
46 locking member
47 connection points for attachment of locking member
48 tool box
49 top step
50 top side of tool box
52 latch on tool box
54 second end of legs of second pair of legs
56 feet on base of legs
58 adjustment device for adjusting position and angle of feet
60 protrusion extending from legs of ladder
62 pivotal connection between top side and receiving section of tool box
64 receiving section of tool box
66 tools within receiving section of tool box
68 recess in base of tool box forming a top step
70 recess in protrusion extending from leg of ladder
72 base side of tool box
74 protrusion extending from base side of tool box
76 enlarged head portion
78 beveled top side of enlarged head portion
80 retaining device
82 pair of recesses in connection device
84 paint can
86 hook
88 recess
90 ledge
92 screw
94 thread spiraling around screw
96 base of screw
98 ball on base of screw
100 recess for receiving ball
102 recess
104 batteries
106 cap covering recess retaining batteries therein
108 first terminal
110 second terminal
112 spring loaded step
114 second embodiment of toolbox
116 drawer
118 latch on drawer
120 plurality of compartments within drawer
122 additional storage compartment within toolbox and behind drawer
123 handle on top side of ladder
124 third embodiment of the toolbox
126 bottom section of toolbox
128 top section of toolbox
130 first pivotal side of toolbox
131 handle on first pivotal side of toolbox
132 second pivotal side of toolbox
133 handle on second pivotal side of toolbox
134 pivotal connection connecting pivotal sides to bottom section
136 back side bottom section
138 plurality of hooks on back side bottom section
140 elongated hook on back side bottom section
142 internal compartment of the bottom section
144 first smaller storage compartment in first side of top section
146 first cover of first smaller storage compartment
148 plurality of recesses extending through first cover
150 indicia printed on first cover
152 second small storage compartment in second side of top section
154 second cover of second smaller storage compartment
156 plurality of recesses extending through second cover
158 indicia printed on second cover
160 additional platform pivotally connected to the bottom section
162 arrow indicating pivoting of additional platform
164 second cover surface pivotally connected to first side
166 arrow indicating pivoting of second cover surface pivotally connected to first side
168 first stand pivotally connected to first cover of first side
170 second stand pivotally connected to first cover of first side
172 arrow indicating direction of pivoting of first cover of first side
174 second cover section pivotally connected to second side
176 paint tray
178 clips on underside of paint tray
180 retaining device on side of paint tray
182 paint brush retained in retaining device
184 work surface
186 top side of work surface
188 clips on top side of work surface
190 fluorescent light bulb
192 recesses extending through work surface
194 light bulb

DETAILED DESCRIPTION OF THE PREFERRED EMBODIMENT

Turning now descriptively to the drawings, in which similar reference characters denote similar elements throughout the several views, FIGS. 1 through 11 illustrate the ladder including storage areas of the present invention indicated generally by the numeral 10. A toolbox and alternate devices which may be releasably connected to the ladder and positioned within the work area are described in detail with reference to FIGS. 12–20.

The ladder including storage areas 10 is formed of a first pair of parallel spaced apart legs 12 and a second pair of parallel spaced apart legs 14, the first pair of legs 12 extending at an adjustable angle to the second pair of legs 14. Each leg of the first pair of legs 14 is pivotally connected at a first end 16 thereof to a connection device 18. Each leg of the second pair of legs 14 is also connected at a first end 20 thereof to the connection device 18. The second pair of legs 14 may also be pivotally connected to the connection device 18.

The first pair of legs 12 have a plurality of steps 22 substantially evenly spaced along the length thereof and extending therebetween. Positioned beneath each of the plurality of steps 22 is a drawer 24. Each drawer 24 includes a handle or latch 26 for sliding the drawer 24 from its position beneath its respective step 22 to reveal a plurality of compartments 28 therein. The plurality of compartments 28 act to retain tools and supplies therein. The latch 26 on each drawer 24 acts to releasably lock its respective drawer 24 in position beneath its respective step 22 when the drawer 24 is slid back beneath the step 22.

A bottom step 30 is positioned between a second end 32 of the first pair of legs 12 and a last step of the plurality of steps 22, the bottom step 30 also extends between the legs of the first pair of legs 12. The bottom step 24 includes a power source 34 and an audible alarm 36. The power source 34 and audible alarm 36 are connected to a pressure sensor as will be discussed hereinafter with specific reference to FIGS. 10 and 11. The pressure sensor detects when a pressure is applied to the bottom step 30 and in response to detecting a pressure applied to the bottom step 30 the audible alarm 34 is activated to generate an audible alarm signal. The audible alarm signal is useful in alerting a user descending the ladder 10 that the bottom step 30 has been reached. This will prevent accidents caused by stumbling on the last step 30.

The second pair of legs 14 includes a stabilizing device 38 extending therebetween. The stabilizing device 38 is preferably in the form of first and second cross bars 40 and 42, respectively. The first and second cross bars 40 and 42, respectively, extend at opposing diagonals to each other and are preferably connected at a point 44 at which they cross one another.

A locking member 46 is positioned between respective ones of the first and second pairs of legs 12 and 14, respectively, for releasably locking the ladder 10 in an open position. The locking member 44 is releasably connected between the respective ones of the first and second pairs of legs 12 and 14 and defines the range of angles at which the first and second pairs of legs 12 and 14, respectively, can pivot with respect to each other. As there is a releasable connection between the locking member 46 and the first and second pair of legs 12 and 14, respectively, the wear and tear on the locking member 46 which normally results in loosening the connection therebetween and rendering the ladder useless is reduced. Alternatively, the locking member 46 may be secured to the first and second pair of legs 12 and 14, respectively, by either screws or snaps at connection points 47 on the legs of the first and second pairs of legs.

Releasably positioned between the legs of both the first and second pair of legs 12 and 14, respectively, at the first ends 16 and 20, respectively, is a tool box 48. A first embodiment of the toolbox 48 is illustrated in FIGS. 1–3. The tool box 48 forms the top step 49 and is positioned in the work area of the user thereby placing any needed tools within reach of the user. The tool box 48 includes a pivotable top 50 and a locking mechanism 52 causing the pivotable top 50 to lock closed thereby securing the tools and supplies within the tool box 48.

Connected to the second side 32 of each leg of the first pair of legs 12 and on a second side 54 of each leg of the second pair of legs 14 are adjustable feet 56. The feet 56 are adjusted with a manual adjuster 58 to adjust the angle of the feet and to move the feet 58 along a horizontal plane with respect to the terrain on which the ladder 10 is to stand. The adjustment of the feet 56 will be discussed hereinafter with specific reference to FIGS. 7, 8 and 9.

FIG. 2 illustrates the tool box 48 positioned atop four protrusions 60, one protrusion 60 extending from each leg of both the first and second pairs of legs 12 and 14, respectively. In this figure a pivotal connection 62 is illustrated as pivotally connecting the top side 50 of the tool box 48 to a retaining section 64 of the tool box 48. The retaining section 64 is used to hold the tools 66 needed by the user therein. The tool box 48 includes a recess 68 positioned under the retaining section 64 providing an additional step for the user to climb on.

FIG. 3 illustrates the releasable connection between the tool box 48 and the protrusions 60. Each protrusion 60 includes a recess 70 extending therethrough. Extending from each corner of a base 72 of the tool box 48 is a protrusion 74. Each of the protrusions have an enlarged head portion 76 with a beveled top side 78. When a pressure is applied to the tool box 48 towards the protrusions 60, the beveled top side 78 is caused to extend into the recess 70. The pressure is applied until the enlarged head portion 76 extends completely through the recess 70. To remove the tool box 48 from its connection with the protrusions 60, a force is applied in a direction opposite the connection force until the protrusions 74 are removed from their position extending through the recess 70.

Figure 5:
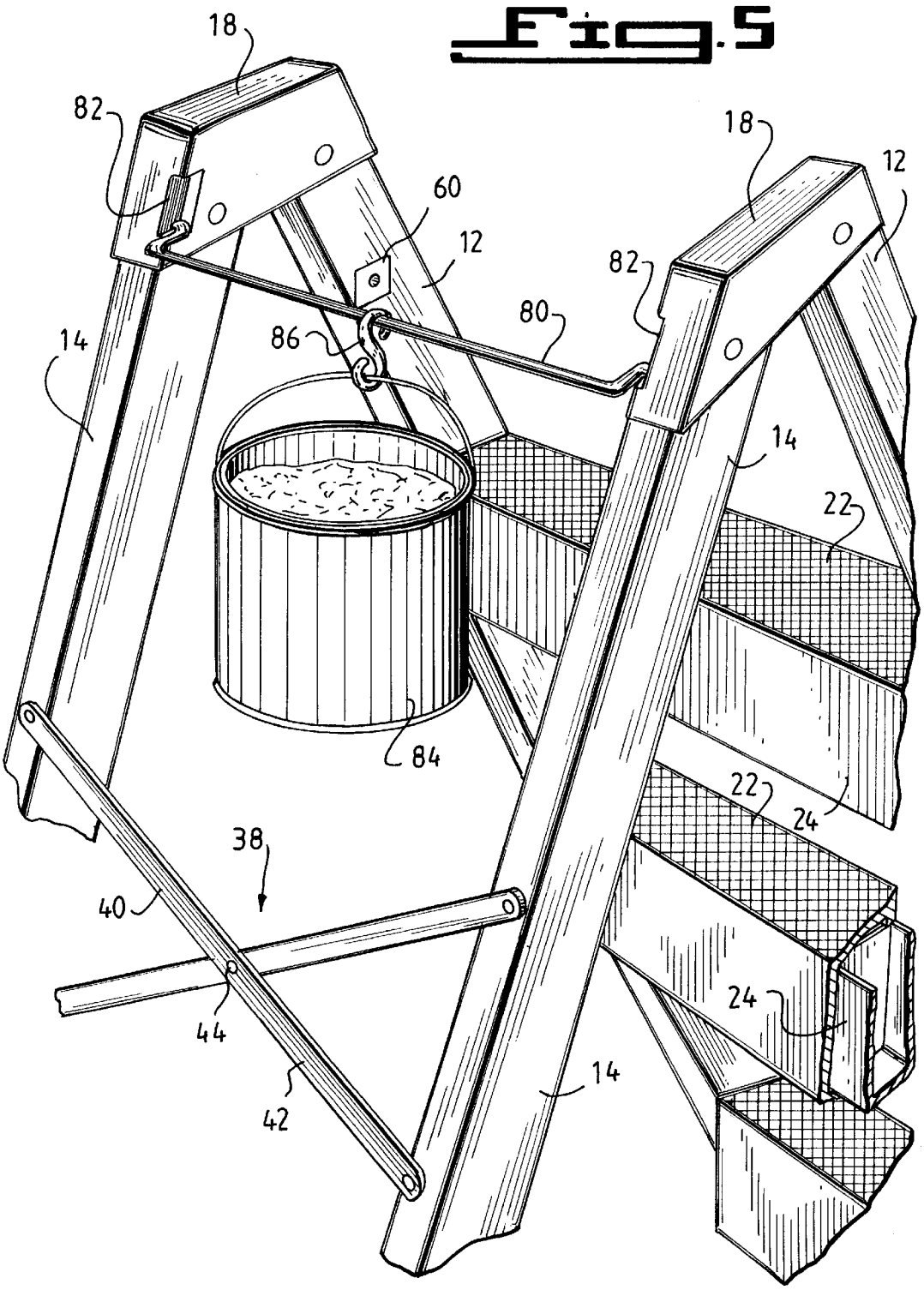
FIG. 5 is a top perspective view of the ladder including storage areas without the toolbox connected thereto of the present invention and including a paint can hanging on the retaining device.

FIG. 4 illustrates a top portion of the ladder including storage areas 10. As can be seen in this figure, the ladder 10 includes a retaining device 80 for holding a tool or supply in a position adjacent the work area and easily accessible to the user. The retaining device 80 is pivotally secured within a pair of recesses 82 extending into the connection device 18 and is movable between a first in use position and a second not in use position. The pair of recesses 82 are positioned above the connection to the second pair of legs 14. The retaining device 80 extends between the legs of the second pair of legs 14 and along a plane parallel to the plurality of steps 22 when in the in use position. The upright not in use position of the retaining device 80 is illustrated in dashed lines. In this position, the retaining device 80 is able to limit the pivoting angle of the top side 50 of the tool box 48. The top side 50 of the tool box 48 is also illustrated in dashed lines. FIG. 5 illustrates a paint can 84 hanging on a hook 86 connected to the retaining device 80.

FIGS. 6, 7, 8 and 9 illustrate the connection between the legs of the ladder 10 and the feet 56. Each leg of both the first and second pairs of legs 12 and 14, respectively, include an identical connection, the only difference being the orientation of the feet and legs. A leg of the first pair of legs 12 will be used in the description for purposes of example only.

Figure 6:
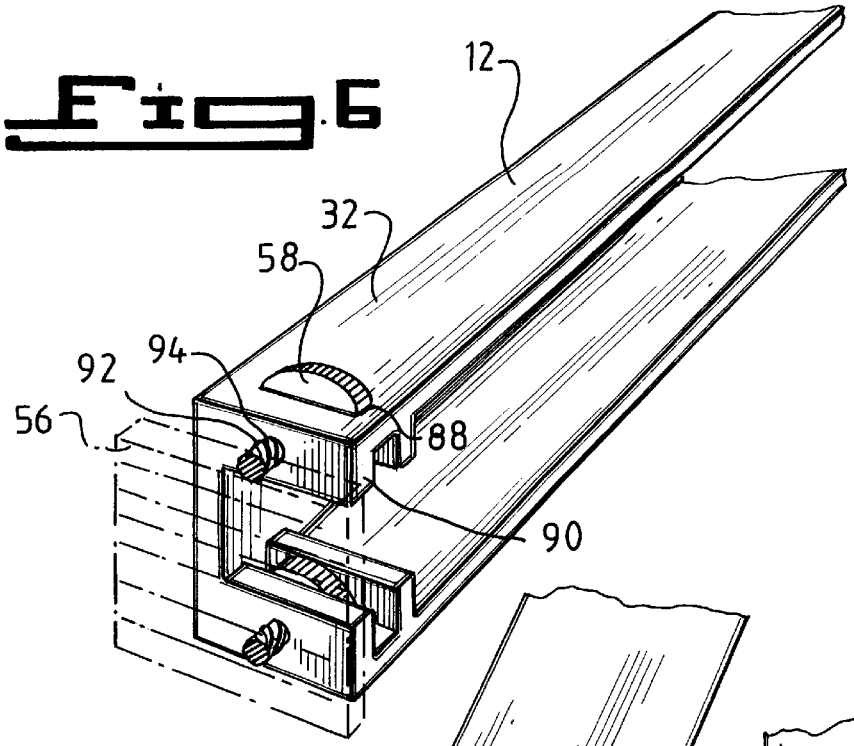
FIG. 6 is an enlarged bottom perspective view of a leg of the ladder including storage areas used with the present invention, the adjustable foot connected at a base of the leg is shown in dashed lines.

FIG. 6 is a bottom perspective view of the connection between the foot 56 and the leg 12, the foot 56 being illustrated in dot-dashed lines. At the bottom side 32 of the leg 12 is a recess 88 through which the adjustment member 58 extends. The leg 12 is hollow and includes a ledge 90 therein on which the adjustment member 58 sits. Extending through the adjustment member is a screw 92 including a thread 94 spiraling therearound. The base 96 of the screw 92 is connected to the foot 56 in a manner which allows the foot to pivot as will be described with specific reference to FIG. 9.

Figure 7:
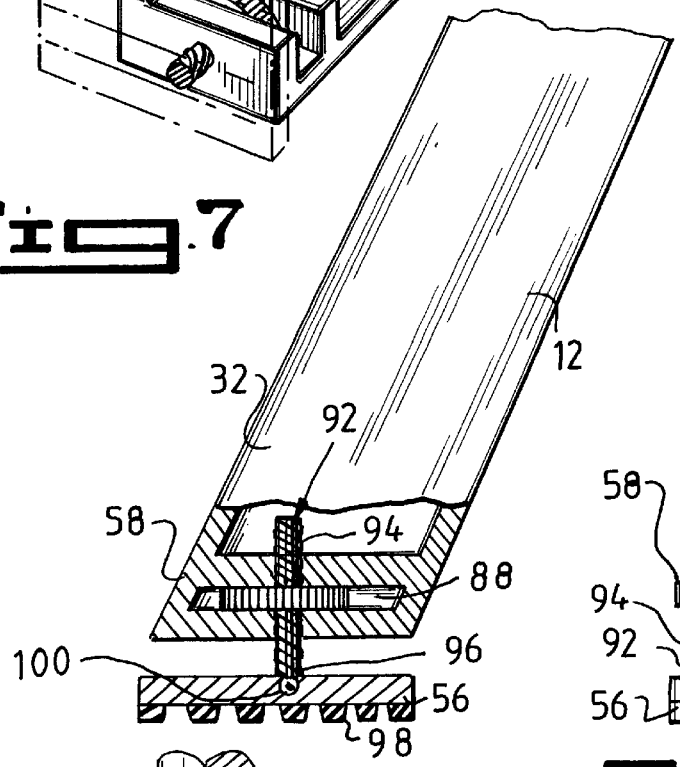
FIG. 7 is a side view in partial cross-section of the leg and foot of the ladder including storage areas of the present invention as shown in FIG. 6.

An enlarged cross sectional view of the leg and foot connection is illustrated in FIG. 7. This view shows a ball 98 connected to the base 96. The ball 98 is received within a round recess 100 extending into the foot 56. The screw 92 extending through the adjustment member 58 is also shown in this figure. The thread 94 spiraling around the screw 92 is engaged with a thread (not shown) spiraling around an inner side of a recess extending through the adjustment member 58 and receiving the screw 92. When the adjustment member 58 is turned in a first direction the engagement of the thread 94 spiraling around the screw 92 and the thread within the recess causes the screw 92 to be fed further out of the leg 12 and thereby increasing the height of the ladder 10. When the adjustment member 58 is turned in a second direction opposite the first direction the engagement of the thread 94 spiraling around the screw 92 and the thread within the recess causes the screw 92 to be fed further into the leg 12 and thereby decreasing the height of the ladder 10.

Figure 8:
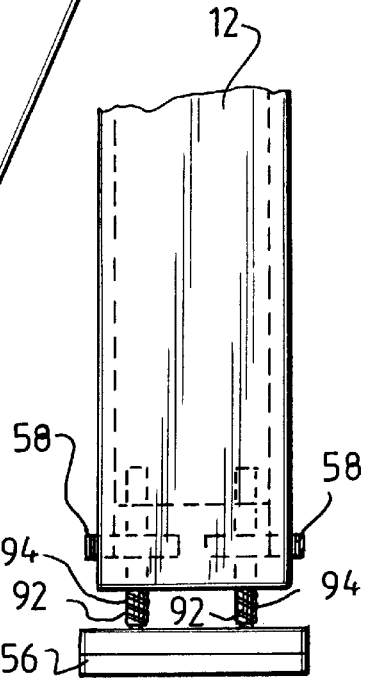
FIG. 8 is a side view of the leg of the ladder including storage areas used with the present invention as shown in FIG. 6, the leg adjustment device being illustrated partially in dashed lines.

A back side view of the connection between the leg and the foot 56 is illustrated in FIG. 8. From this view it is shown that an adjustment device 58 is positioned on each side of the leg 12. The positioning of the adjustment members on either side of the foot 56 allows the user to cause one side of the foot 56 to extend down further than the other side of the foot 56 and thus allow the foot to be angled based upon the terrain on which the ladder is to sit.

Figure 9:
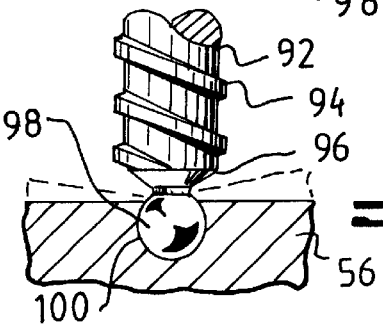
FIG. 9 is an enlarged side view of the connection between a foot and its respective leg of the ladder including storage areas used with the present invention.

An enlarged view of the pivotal connection between the foot 56 and the screw 92 is shown in FIG. 9. As can be seen from this figure, the ball and socket connection allows the foot 56 to pivot as illustrated in dashed lines. The pivoting of the foot 56 in this manner is dependent on the terrain on which the ladder 10 will sit and allows the ladder 10 to stand firmly on the terrain without shaking due to uneven terrain.

Figure 10:
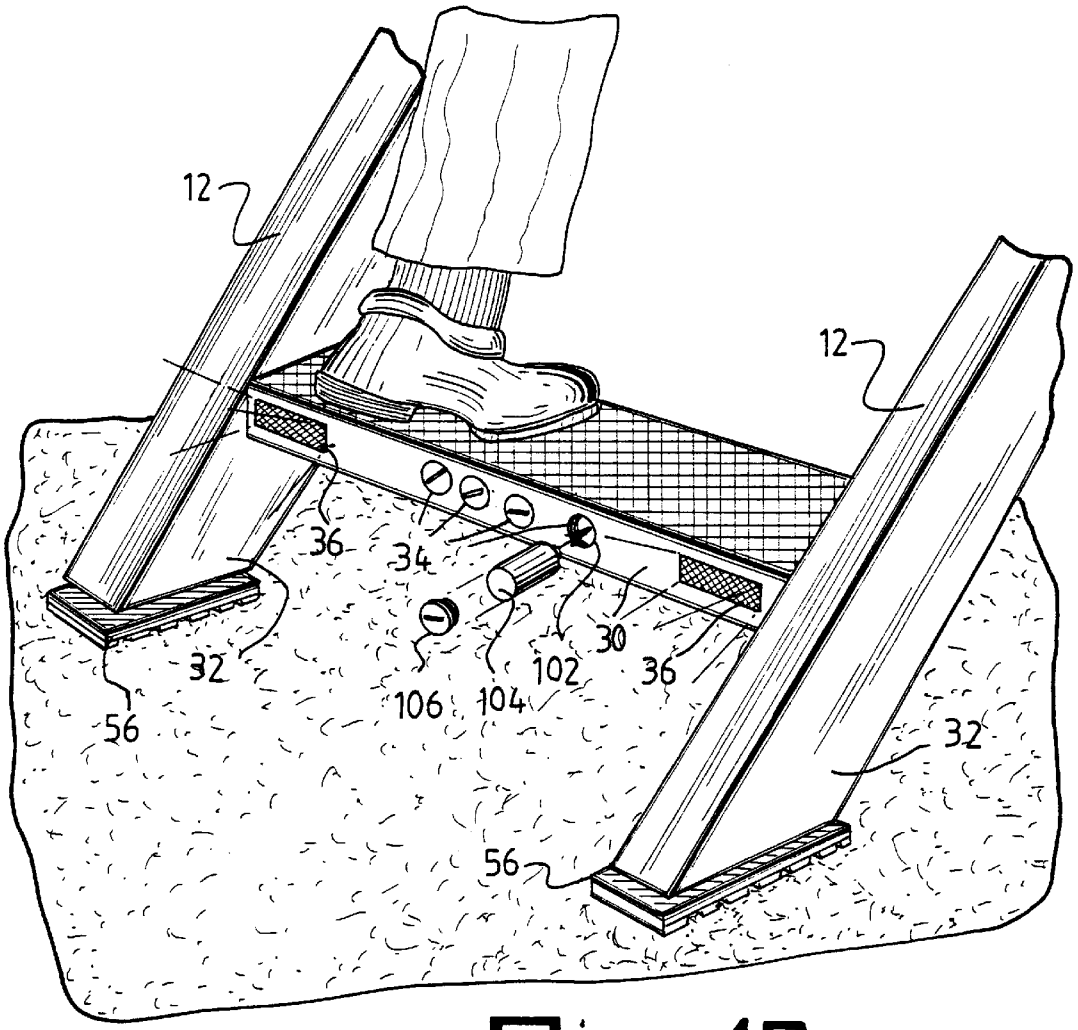
FIG. 10 is an enlarged perspective view of the bottom step and pressure alarm of the ladder including storage areas used with the present invention, a battery compartment for powering the alarm being illustrated in an exploded view.

The bottom step 30 is illustrated in FIG. 10. This figure illustrates the pressure sensitive alarm positioned within the bottom step 30. The power source 34 includes a plurality of recesses 102 extending into the bottom step 30 within each recess is seated a battery 104 for providing power to the pressure sensitive alarm. A cap 106 is positioned to retain the batteries 104 within their respective recess 102. The use of a plurality of individual batteries 104 provides the pressure sensitive alarm with an added life and allows the pressure sensitive alarm to continue operation even if one battery malfunctions.

Figure 11:
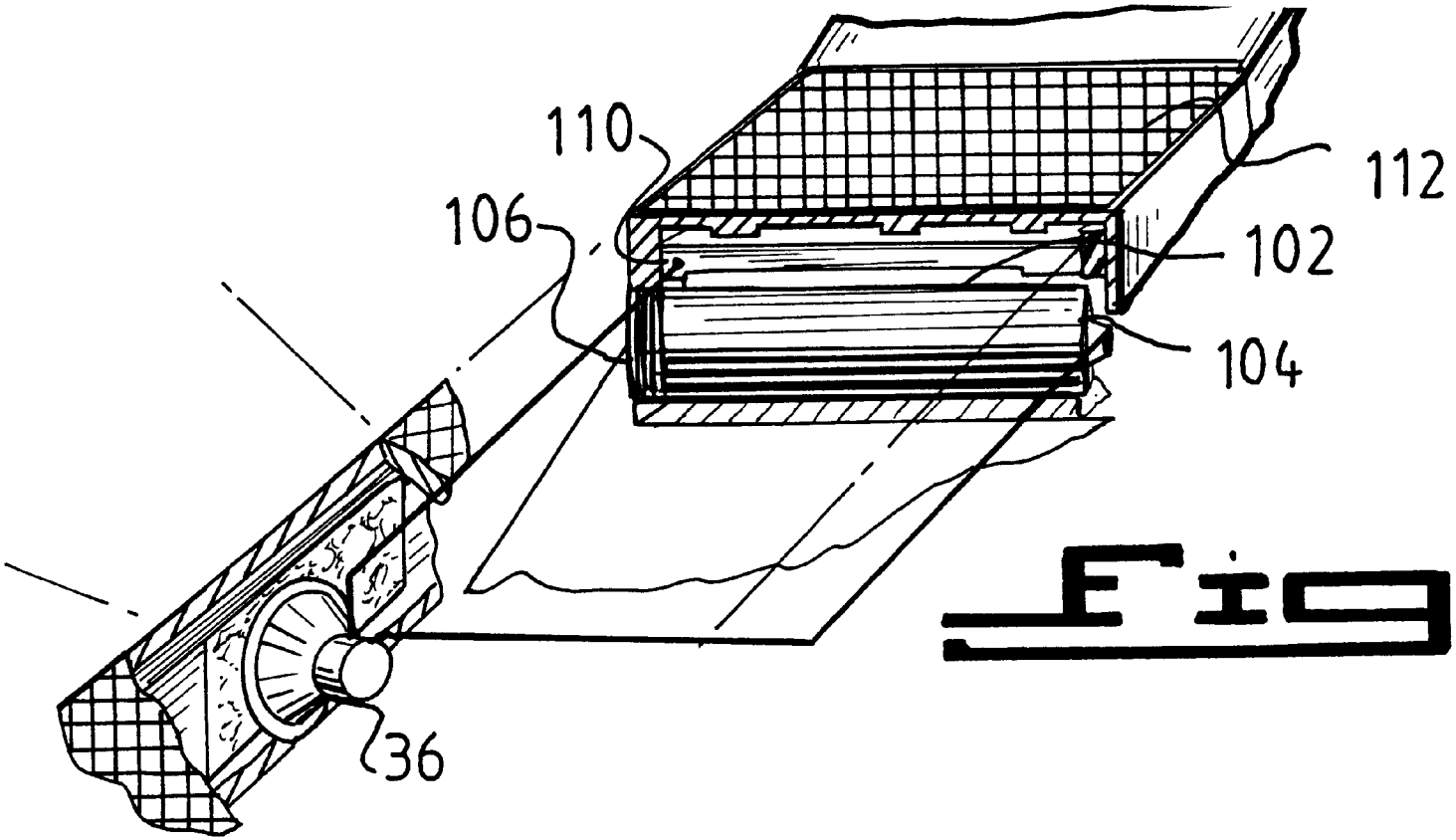
FIG. 11 is an exploded partial cross-sectional view of the bottom step of the ladder including storage areas used with the present invention and illustrating the connection between the battery and the pressure sensor.

FIG. 11 illustrates an enlarged cross-sectional view of the pressure sensitive alarm showing the connections between the elements thereof. Also positioned within each recess 102 are first and second terminals 108 and 110. The first and second terminals 108 and 110 are connected to a spring loaded step 112. The first and second terminals 108 and 110 are also connected to the audible alarm 36. When a user applies pressure to the spring loaded step 112 as illustrated in FIG. 10 such as when the step is stepped on, the first and second terminals 108 and 110 are caused to contact the terminals of the battery 104 positioned within the recesses 102. Power is thus applied to the audible alarm 36 through the connection to the first and second terminals 108 and 110 causing an audible alarm signal to be produced. Thus, the user is alerted that the bottom step 30 has been reached and thereby minimizes the possibility of stumbling off of the ladder 10. The alarm signal will be produced for as long as pressure is applied to the spring loaded step 112. Upon removal of the pressure the first and second terminals 108 and 110 are removed from contact with the terminals of the batteries 104 and thus power is no longer applied to the audible alarm 36.

Figure 12:
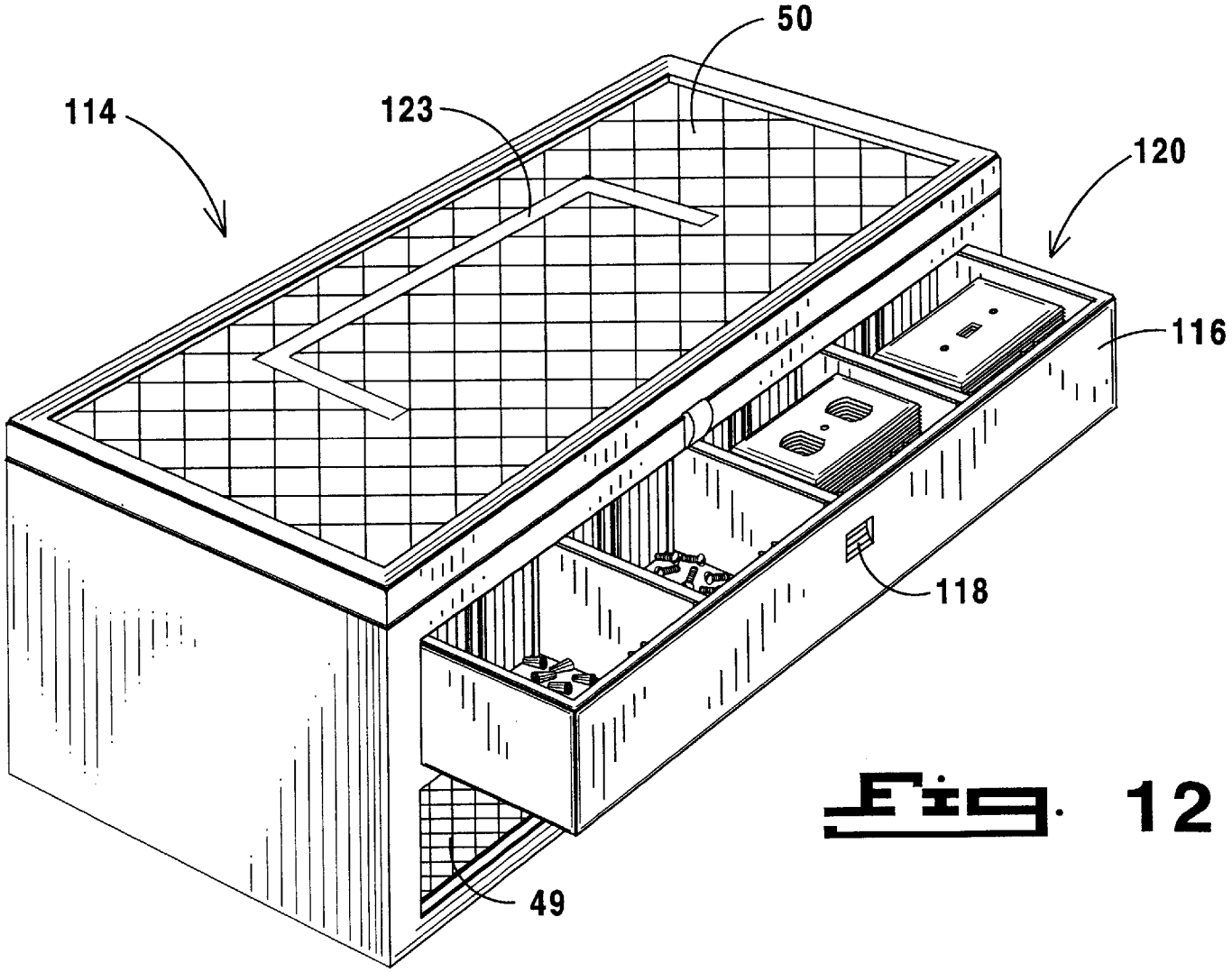
FIG. 12 is an enlarged top perspective view of a second embodiment of the tool box used with the present invention, the toolbox including a pull out drawer including dividers therein for storing tools and supplies.
Figure 13:
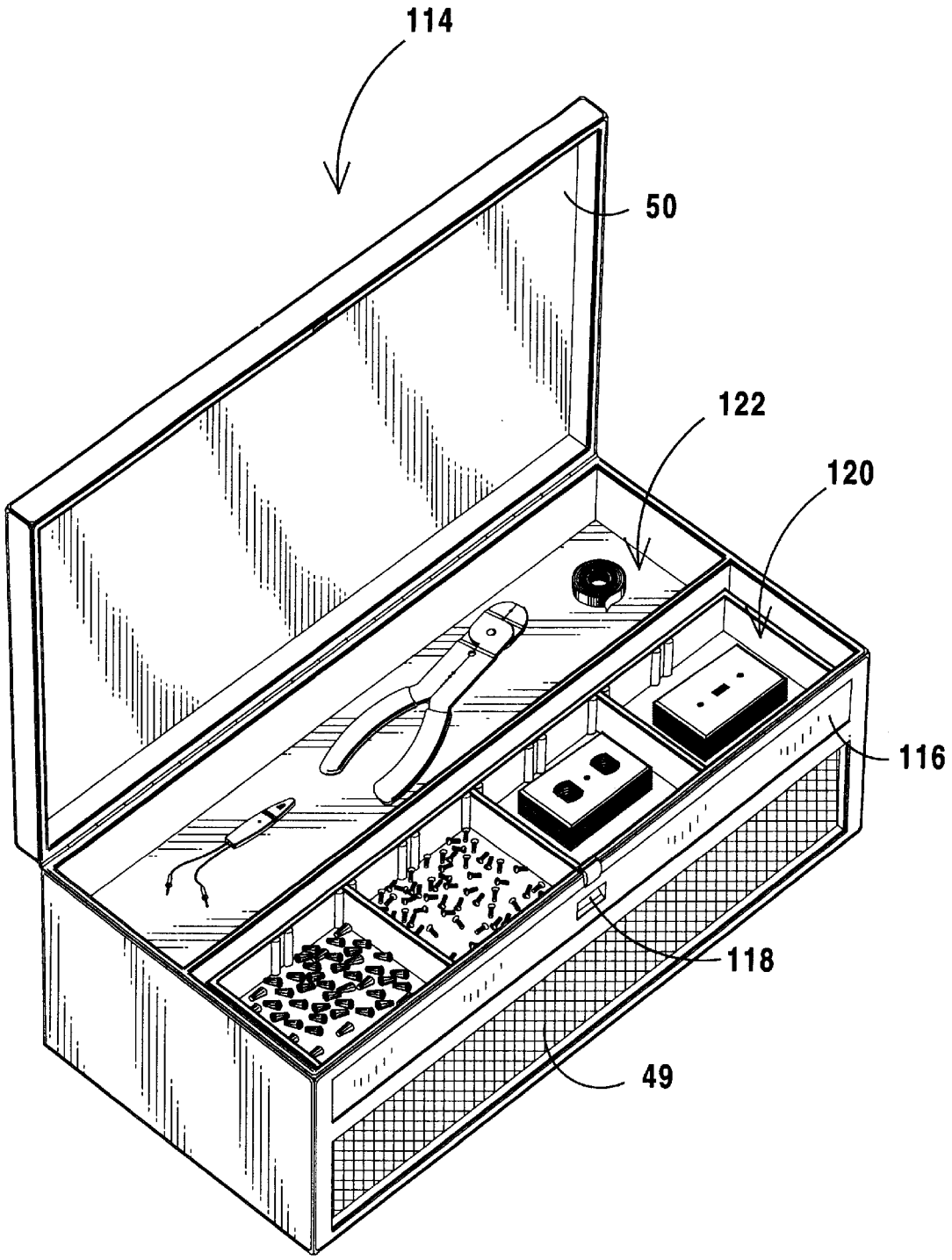
FIG. 13 is a front perspective view of the second embodiment of thetoolbox illustrated in FIG. 12 with the top pivoted into the open position.
Figure 14:
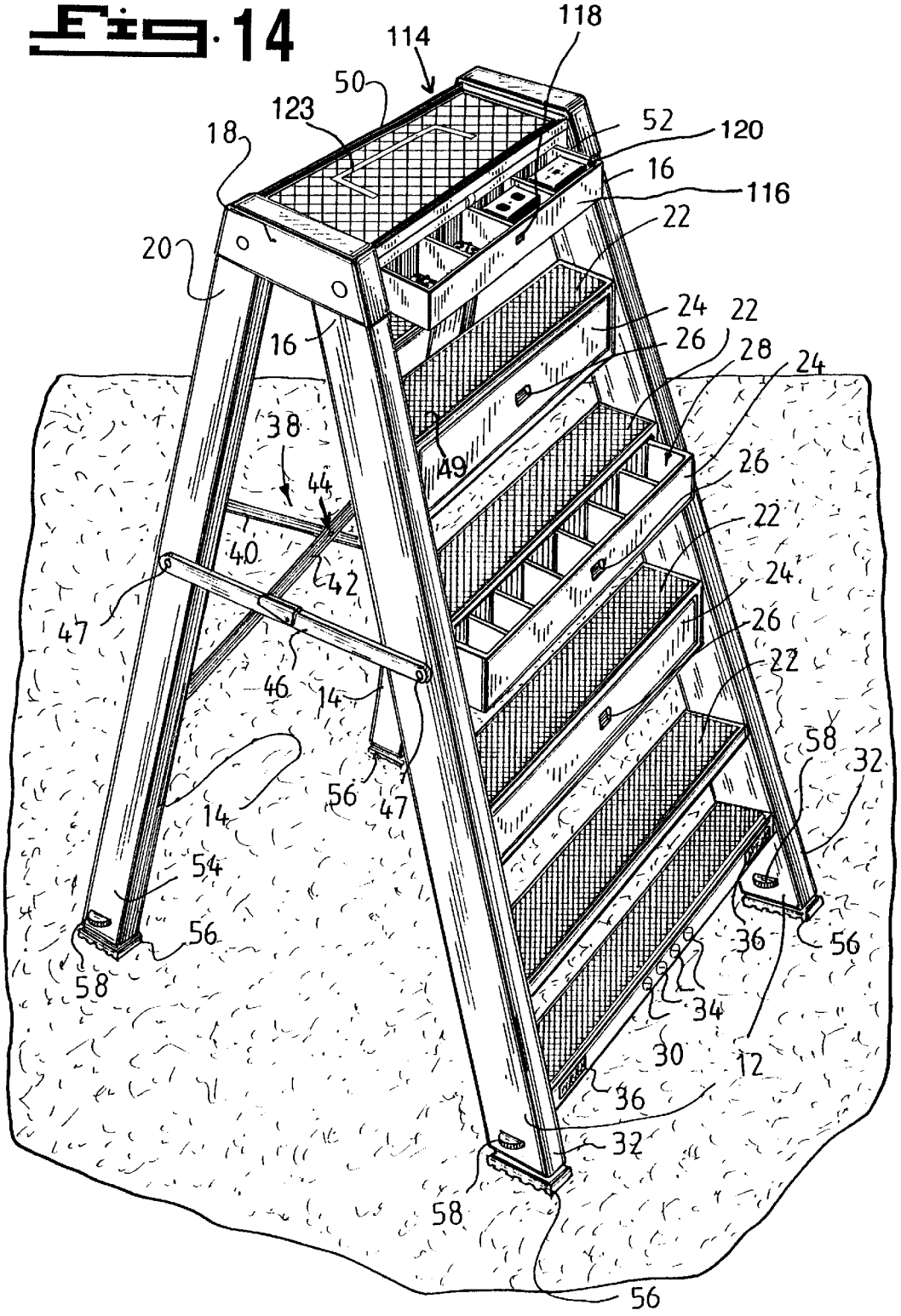
FIG. 14 is a front perspective view of the toolbox shown in FIGS. 12 and 13 releasably connected to the ladder including storage areas used with the present invention.

A second embodiment of the toolbox is illustrated in FIGS. 12–14 and indicated generally by the numeral 114. Similar elements of the second embodiment of the toolbox 114 and the toolbox described hereinbefore will be identified with identical reference numerals.

The toolbox 114 illustrated in FIGS. 12–14 is releasably connectable to the ladder 10 and is positioned in the work area of the user thereby placing any needed tools within reach of the user. The toolbox 114 forms the top step 49 of the ladder 10 allowing the user to stand thereatop. The tool box 114 includes a pivotable top 50 and a locking mechanism 52 causing the pivotable top 50 to lock closed thereby securing the tools and supplies within the tool box 48. Also positioned below the pivotal top 50 is a drawer 116. The drawer 116 includes a handle or latch 118 for sliding the drawer 116 from its position beneath the pivotal top 50 to reveal a plurality of compartments 120 therein. The plurality of compartments 120 act to retain tools and supplies therein. The latch 118 on each drawer 116 acts to releasably lock the drawer 118 in position beneath the pivotal top 50 when the drawer 24 is slid back beneath the pivotal top 50. When the pivotal top 50 is pivoted into the open position as shown in FIG. 13, an additional storage compartment 122 for retaining tools therein. A handle 123 is positioned on the top side 50 of the toolbox 114 allowing the user to remove the toolbox 114 from its position atop the ladder 10. The handle 123 also provides a means for carrying the toolbox 114 separately from the ladder 10 and thereby allowing the toolbox 114 to be used independently of the ladder 10.

A third embodiment of the toolbox is illustrated in FIGS. 15–18 and indicated generally by the numeral 124. The toolbox 124 illustrated in these figures is releasably connectable to the ladder 10 and is positioned in the work area of the user thereby placing any needed tools within reach of the user. When connected to the ladder 10, the toolbox 124 forms the top step of the ladder allowing the user to stand thereatop. The toolbox 124 includes a bottom section 126 for retaining tools therein and a top section 128 formed of first and second pivotal sides 130 and 132, respectively which when pivoted into the open position provides access to the tools within the bottom section 126. A pivotal connection 134 connects each of the first and second pivotal sides 130 and 132 to the bottom section 126. A handle 131 is positioned on a top side of the first pivotal side 130 and a handle 133 is positioned on a top side of the second pivotal side 132 of the toolbox 124. The handles 131 and 133 are used for carrying the toolbox 124 independently of the ladder 10. On a back side 136 of the bottom section 126 are a plurality of hooks 138 for receiving a tools, supplies or even a utility belt thereon and retaining the items retained thereby within the work area and easily accessible to the user. An elongated hook 140 also extends from the back side 136 for providing additional stability to the toolbox 124. The elongated hook 140 is to be positioned over the retaining device and thereby securing the toolbox 124 to the ladder 10.

When the first and second sides 130 and 132, respectively, are pivoted into the open position the internal compartment 142 of the bottom section 126 is exposed. The first side 130 forms a first smaller storage compartment 144 and includes a first cover 146 pivotally connected thereto for closing the first smaller storage compartment 144. The first cover 146 includes a plurality of recesses 148 extending therethrough and indicia 150 printed thereon providing a ruler for the user. The second side 132 also forms a second small storage compartment 152 and includes a second cover 154 pivotally connected thereto for closing the second small storage compartment 152. The second cover 154 also includes a plurality of recesses 156 extending therethrough and indicia 158 printed thereon providing a ruler for the user.

Figure 15:
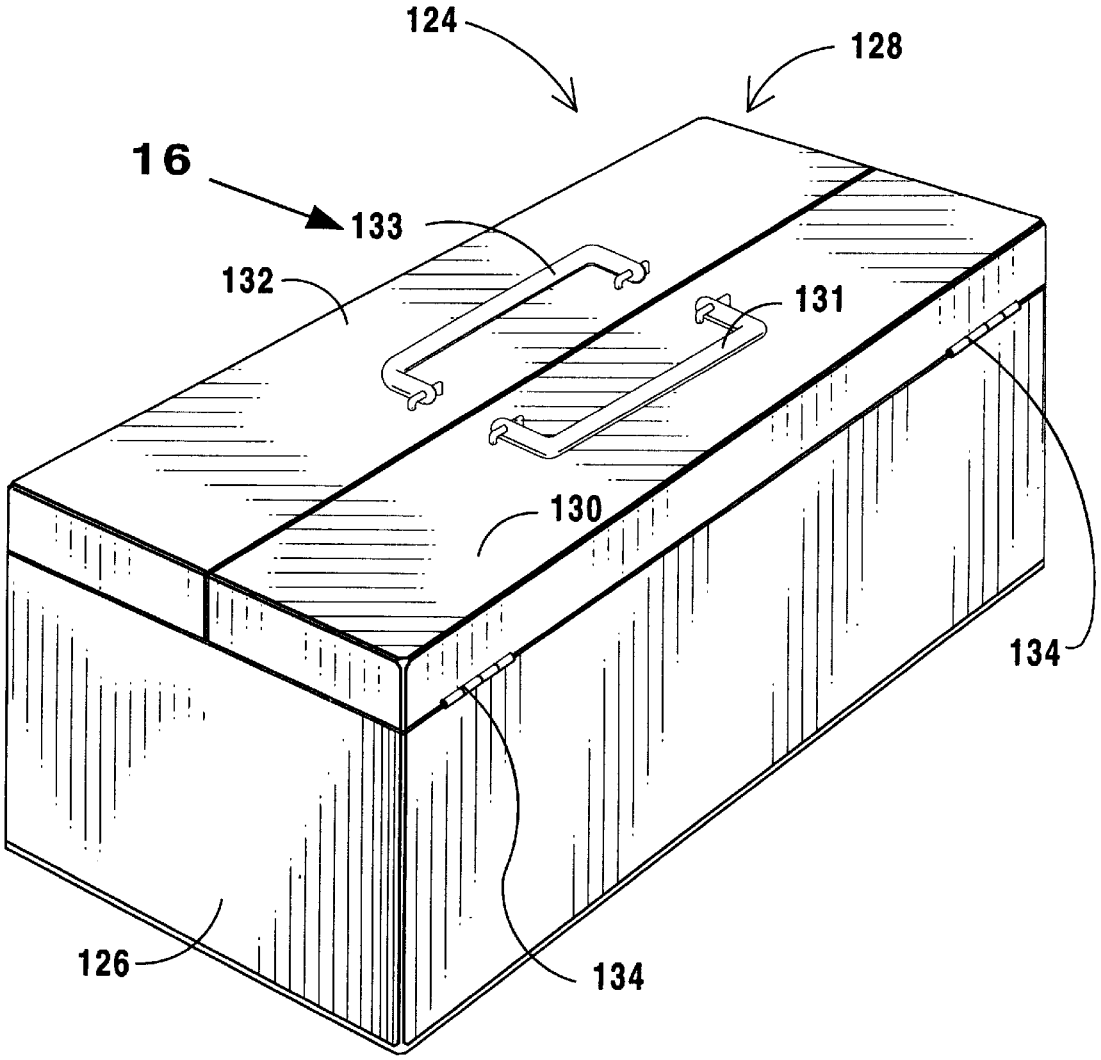
FIG. 15 is a top perspective view of a third embodiment of the tool box used with the present invention, the toolbox including a pull out drawer including dividers therein for storing tools and supplies.
Figure 16:
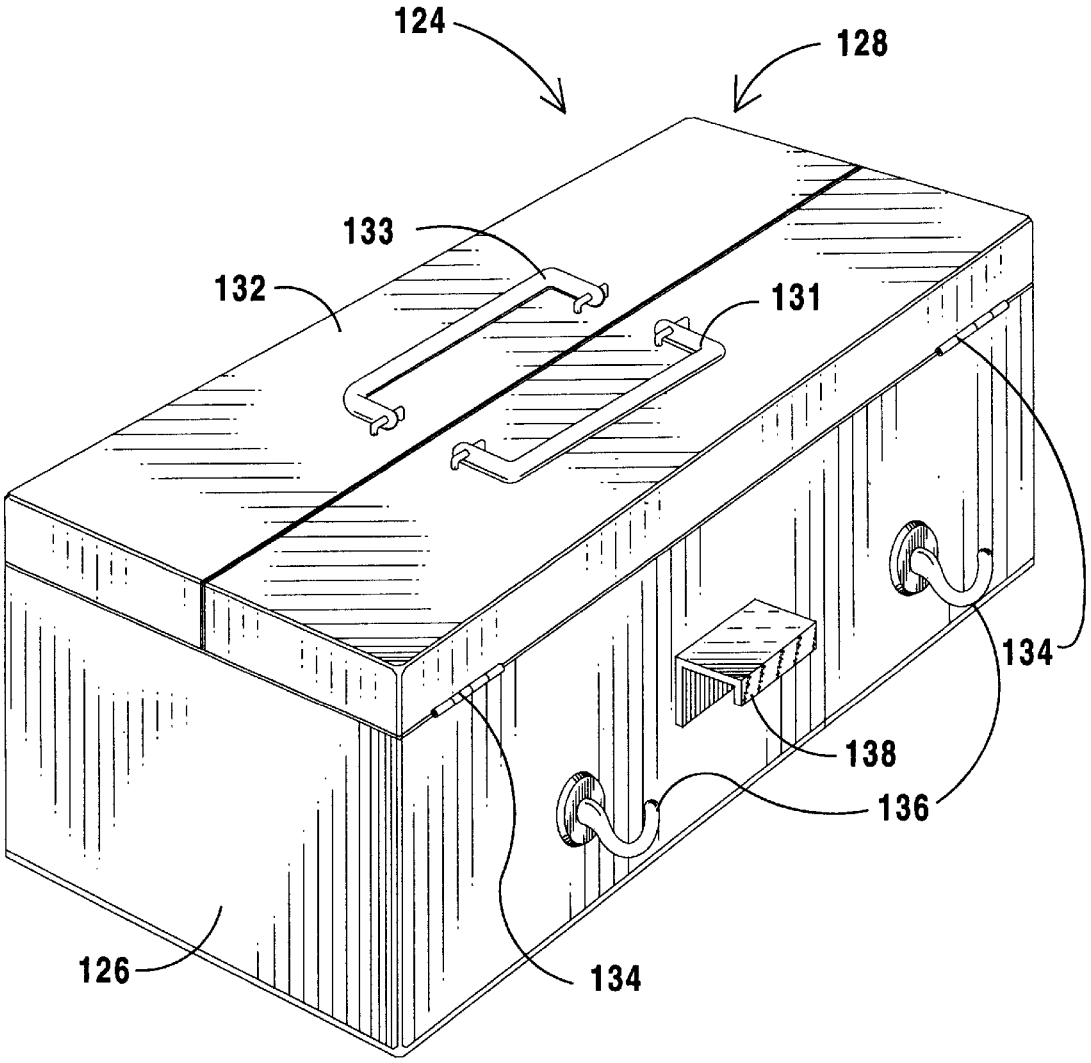
FIG. 16 is a rear perspective view of the third embodiment of the tool box used with the present invention taken in the direction of the arrow labeled 16.
Figure 17:
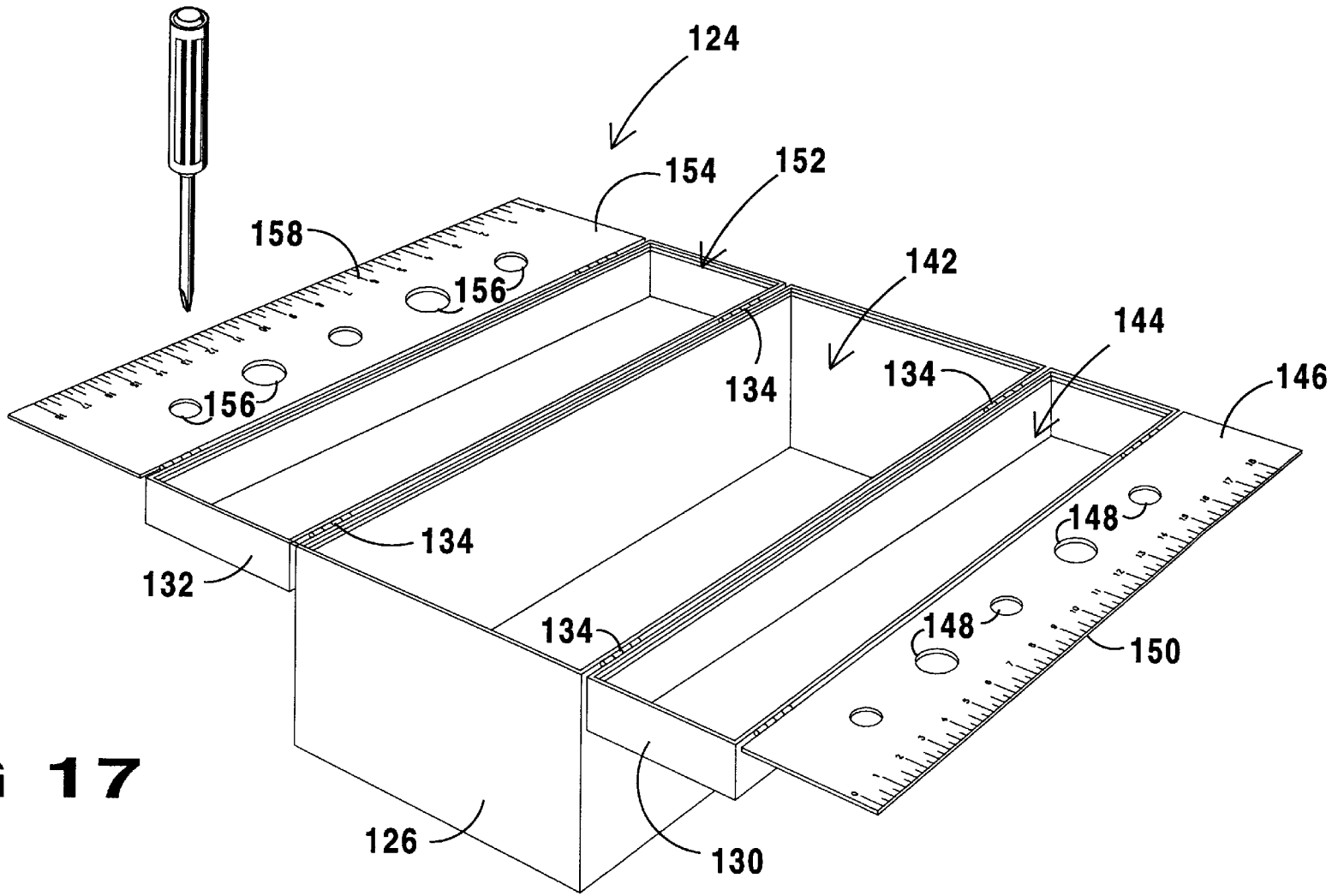
FIG. 17 is a top perspective view of the third embodiment of the tool box used with the present invention shown in FIGS. 15 and 16 with the main compartment doors in the fully open position.
Figure 18:
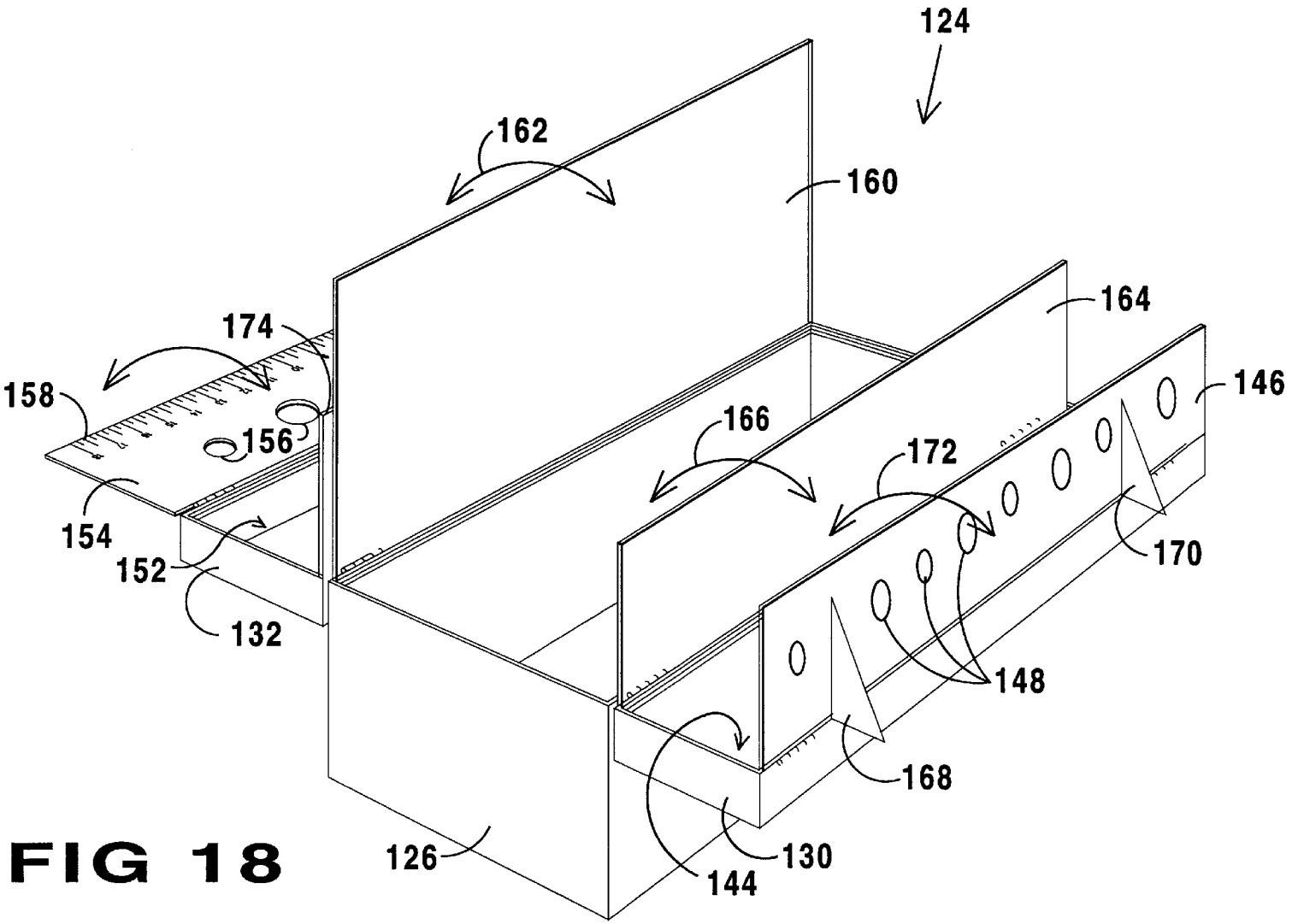
FIG. 18 is a top perspective view of the third embodiment of the tool box used with the present invention shown in FIGS. 15–17 illustrating additional compartments within the doors to the toolbox.

FIG. 18 illustrates the toolbox 124 of FIGS. 15–17 including an additional platform 160 pivotally connected to the bottom section 126. The additional platform covers the bottom section when in the closed position and provides access to the bottom section when pivoted into the open position as illustrated in FIG. 18. Arrow 162 illustrates the direction of pivoting of the additional platform 160. When the first and second sides 130 and 132 of the top section 128 are pivoted into the open position, the additional platform provides a flat surface on which the user may work.

The first side 130 also includes a second cover section 164 for covering the first storage compartment 144. The second cover section pivots as indicated by the arrow labeled 166. When pivoted into the open position indicated in FIG. 18, access to the first storage area is provided and when the second cover section is pivoted into the closed position access to the first storage area is prevented. Pivotally connected to a back side of the first cover 144 are first and second stands 168 and 170. The first and second stands 168 and 170 retain the first cover 144 in a level position when pivoted into the open position. When the first side 130 is pivoted as indicated by the arrow labeled 172 into the open position, the first cover is pivoted into the open position with the first and second stands 168 and 170 contacting the side of the first side 130 and the second cover section 164 is pivoted into the closed position, an additional flat surface is provided for the user to work on.

The second side 132 also includes a second cover section 174 for covering the second storage compartment 152. The second cover section 174 is pivotally connected to the second side 132. When pivoted into the open position indicated in FIG. 18, access to the second storage area 152 is provided and when the second cover section 174 is pivoted into the closed position access to the second storage area 152 is prevented. Pivotally connected to a back side of the second cover 154 are stands for retaining the second cover 154 in a level position when pivoted into the open position. When the second side 132 is pivoted into the open position, the first cover 154 is pivoted into the open position with the stands contacting the side of the second side 132 and the second cover section 174 is pivoted into the closed position, an additional flat surface is provided for the user to work on. An enlarged work area is thus provided by the additional platform 160, the first cover 146 of the first side 130, the second cover section 164 of the first side 130, the first cover 154 of the second side 132 and the second cover section of the second side 132.

Figure 19:
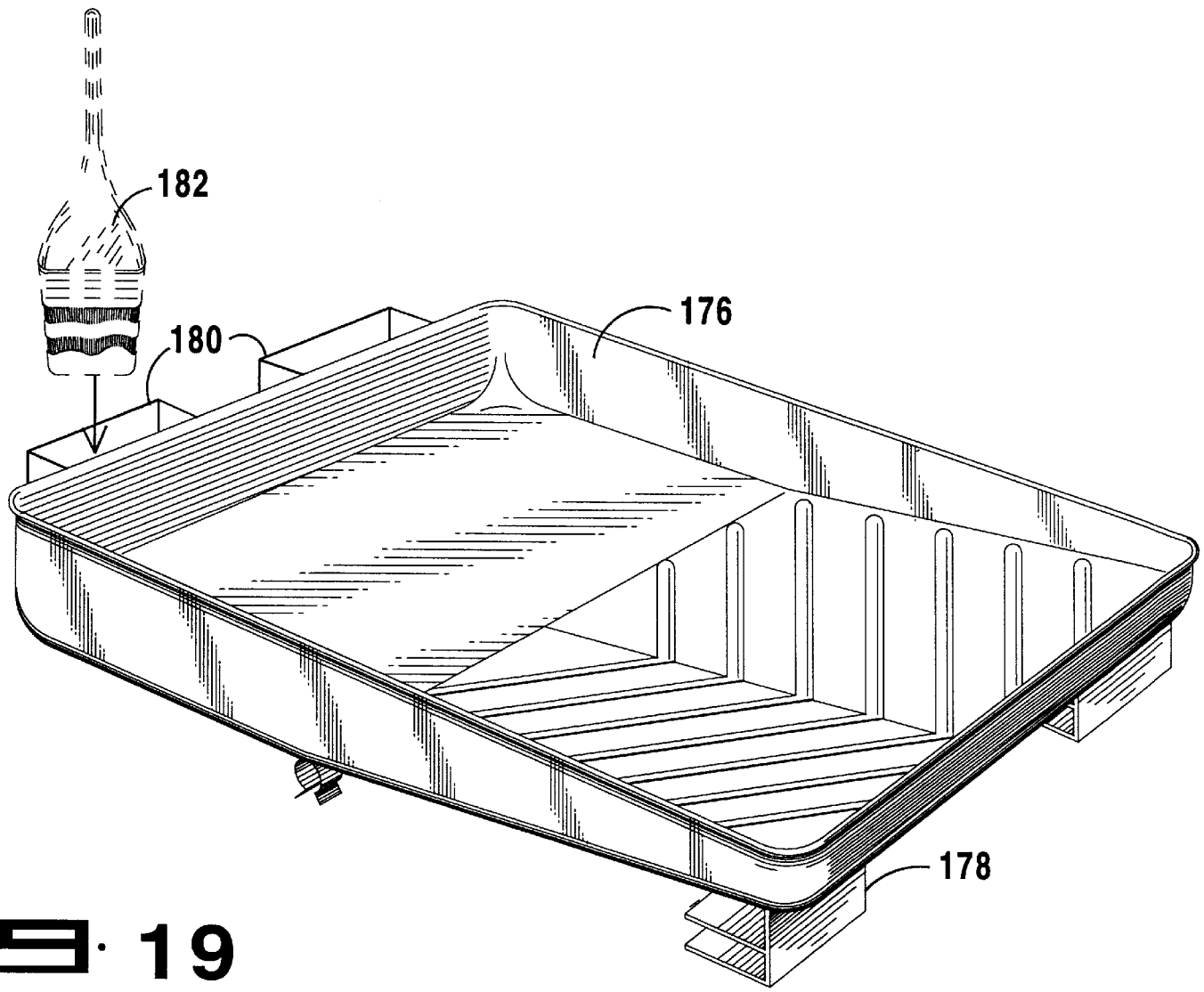
FIG. 19 is a top perspective view of a paint tray which may be releasably connected to the ladder in lieu of the toolbox.

Alternatively, a paint tray 176 as illustrated in FIG. 19 may be attached to the ladder 10 in lieu of the toolbox for enabling the ladder to be used for painting an area. The paint tray includes clips 178 on an underside thereof for engaging the protrusions 60 extending from the legs of the ladder 10 to thereby retain the paint tray 176 in place atop the ladder 10. Also extending from one end of the paint tray 176 are receiving devices for retaining a paint brush 182 therein and readily available to the user.

Figure 20:
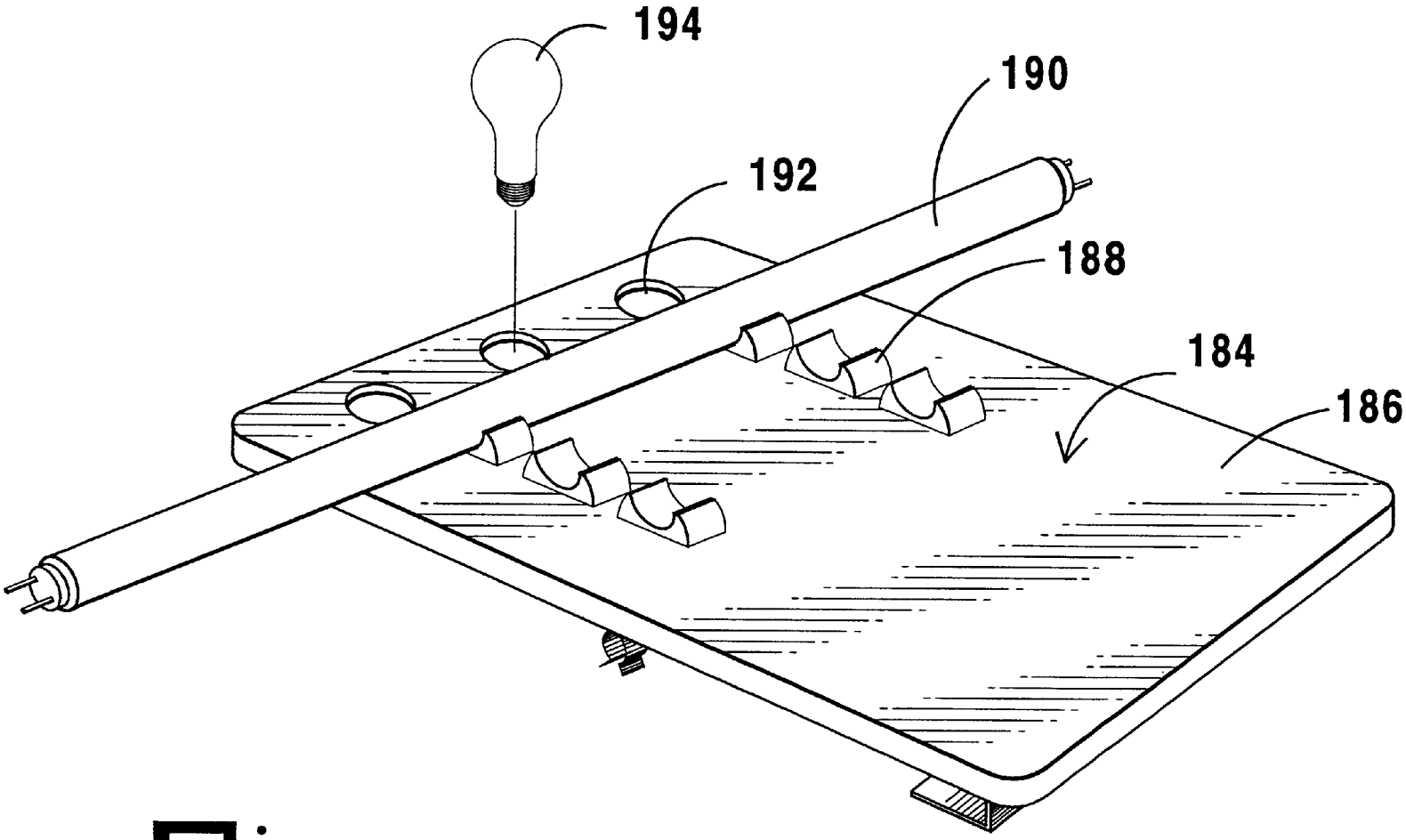
FIG. 20 is a top perspective view of an alternative work surface having a number of holes and clips for releasably retaining supplies therein which may be releasably connected to the ladder in lieu of the toolbox.

FIG. 20 illustrates a further work surface 184 which may be releasably connected to the top of the ladder. The work surface 184 includes clips 186 on an underside thereof for engaging the protrusions 60 extending from the legs of the ladder 10 to thereby retain the work surface 184 in place atop the ladder 10. Positioned on a top side 186 of the work surface 184 are a plurality of clips 188 for receiving fluorescent light bulbs 190 therein and readily accessible to the user when replacing a light bulb. Extending through the work surface 184 are a plurality of recesses 192 for receiving light bulbs 194 therein and readily accessible to the user when replacing a light bulb.

The operation of the ladder including storage areas 10 will now be described with reference to the figures. In operation, the storage compartments 28 of the ladder including storage areas 10 are first filled with the tools necessary to perform the desired operation and the recesses 102 are loaded with batteries 104 so the audible alarm will operate. The ladder 10 is then transported to the work area.

At the work area the terrain is examined and the angle and height of the feet 56 are adjusted to meet the terrain. This allows the ladder 10 to stand firmly in the work area without the possibility of tipping or being unstable. The first and second pair of legs 12 and 14 are then separated to the desired angle thus providing the ladder 10 with the desired height. The locking member 46 is then secured in position to lock the first and second pairs of legs 12 and 14 at their desired angle.

The tool box 48 may now be secured atop the ladder 10 by applying pressure towards the protrusions 60 such that the protrusions 74 are caused to extend through the recesses 70. The tool box 48 is now secured at the top of the ladder 10 and readily accessible to the user. The retaining device 80 is then placed in the in use position and any desired tool or supply may be connected thereto and be easily accessible to the user. The ladder 10 may now be used to complete the desired task.

Once the task is finished, the tool or supply hanging from the retaining device 80 is removed. Next, the tool box 48 is removed by applying a force in a direction opposite the force used to secure it in position. This force is applied until the protrusions 74 are removed from the recesses 70. The locking member 46 is then removed and the first and second pairs of legs 12 and 14 are moved towards each other causing the ladder 10 to be in a closed position. The ladder 10 can now be stored until it is desired to use the ladder 10 again.

From the above description it can be seen that the ladder including storage areas of the present invention is able to overcome the shortcomings of prior art devices by providing a ladder including storage areas which is able to retain a desired tool in an easily accessible position adjacent the user and store numerous tools and other desired items in storage cabinets positioned so as not to obstruct the user. The storage cabinets are in the form of pull out drawers located beneath the steps of the ladder and including a snap lock to lock the storage cabinets in place upon return to a position beneath its respective step. The ladder including storage areas also includes a tool box removably positioned within the work area defined by the ladder and is able to generate an alarm signal indicating when the user has reached the bottom step thereby preventing the possibility of the user stumbling when descending from the ladder, the alarm signal being generated by a pressure sensor positioned in the bottom step and activated when a user applies a pressure to the step such as by stepping thereon. The ladder also includes storage areas having adjustable feet on a base of the legs of the ladder thereby adding stability to the ladder when in use, the feet being both angularly and height adjustable. Alternatively, the ladder including storage areas may include a toolbox designed to retain and store supplies and tools related to the particular job to be performed releasbly positioned within the work area of the user or a paint tray or storage tray may be releasably connected atop the ladder and within the work area of the user in lieu of the toolbox. Furthermore, the ladder including storage areas of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A ladder including storage areas comprising:

a) a first pair of legs;

b) a second pair of legs extending at an adjustable angle to said first pair of legs;

c) a plurality of steps extending between said legs of said first pair of legs;

d) a plurality of storage compartments, each of said plurality of storage compartments positioned below a respective one of said plurality of steps and movable between a first position completely contained beneath its respective step and a second position extending out from its respective step providing access to a storage area, e) a tool box including a tool retaining section, a top cover pivotally connected to said tool retaining section and a recess extending into a side of said tool retaining section on a base side of said toolbox providing a top step on which the user may step; and f) means for releasably connecting said tool box in a work area of said ladder and easily accessible to a user, wherein each leg of said first and second pairs of legs include a connection nub extending therefrom, each connection nub including a recess extending therethrough and said tool box further includes at least two protrusions extending from an underside thereof, said at least two protrusions being removably received by a respective one of said recesses in said connection nub when said tool box is connected in the work area.

2. The ladder including storage areas as recited in claim 1, wherein each of said plurality of storage compartments include a latch for releasably locking said storage compartment in said first position.

3. The ladder including storage areas as recited in claim 2, wherein each of said plurality of storage compartments further include a plurality of dividers therein for providing a plurality of storage areas for separating tools and supplies.

4. The ladder including storage areas as recited in claim 1, further comprising adjustable feet connected to each leg of said first and second pair of legs.

5. The ladder including storage areas as recited in claim 4, wherein said adjustable feet are angularly adjustable to meet a slope of terrain on which said ladder is positioned.

6. The ladder including storage areas as recited in claim 5, wherein said adjustable feet are adjustable in height for matching an uneven terrain on which said ladder is positioned and providing added stability thereto.

7. The ladder including storage areas as recited in claim 1, further comprising means for securing said first and second pair of legs at a desired angle.

8. The ladder including storage areas as recited in claim 7, wherein said means for securing is removably connected to both said first and second pair of legs.

9. The ladder including storage areas as recited in claim 1, further comprising a pressure sensor positioned within a bottom one of said plurality of steps.

10. The ladder including storage areas as recited in claim 9, wherein said pressure sensor generates an audible alarm signal when pressure is applied to said bottom one of said plurality of steps.

11. The ladder including storage areas as recited in claim 1, further comprising means for retaining one of a tool and supply in an easily accessible position for a user connected to said ladder.

12. The ladder including storage areas as recited in claim 1, further comprising means for retaining one of a tool and supply in an easily accessible position for a user connected to said ladder.

13. The ladder including storage areas as recited in claim 12, wherein said tool box includes a top cover pivotally connected thereto.

14. The ladder including storage areas as recited in claim 13, wherein said means for retaining is operable between a first position for retaining one of the tool and supply thereon and a second position defining a range of angles within which said top cover is pivotable.

15. The ladder including storage areas as recited in claim 1, wherein said at least two protrusions each include an enlarged head section with a beveled top side for receipt within its respective recess.

16. The ladder including storage areas as recited in claim 1, wherein said toolbox includes a base section, a top cover pivotally connected to the base section and forming a top step of said ladder, a face side and a storage compartment extending into said base section and movable between a first position completely contained within said toolbox and a second position extending out from said toolbox providing access to a storage area.

17. The ladder including storage areas as recited in claim 16, wherein said toolbox further includes a recess extending into a side of said storage compartment and on a side of said storage compartment opposite said top cover providing an additional step on which the user is able to climb.

18. The ladder including storage areas as recited in claim 17 further including a handle positioned on said top cover for removing said toolbox from a position atop the ladder and carrying said toolbox separately from said ladder.

19. The ladder including storage areas as recited in claim 1, wherein said toolbox includes:

a) a base section having a platform pivotally connected thereto for providing selective access to said base section; and b) a cover section, said cover section including first and second side compartments, each side compartment being pivotally connected to opposing sides of said base section and including a first cover section pivotally connected thereto for providing selective access to said respective compartment, wherein said first and second side compartments are pivotable between a first position preventing access to said base section and a second position pivoted to provide access to said base section, said respective first cover sections extending parallel to said platform and providing an extended work area for the user when said first and second side compartments are in said second position.

20. The ladder including storage areas as recited in claim 19, wherein said first and second compartments each further include second cover sections pivotally connected to a side of said respective compartment, said second cover section pivotal in a direction opposite said first cover section and including at least one recess extending therethrough for receiving a tool therein and indicia printed thereon.

21. The ladder including storage areas as recited in claim 20, wherein said indicia identifies units of length.

22. The ladder including storage areas as recited in claim 21, wherein said second cover sections each include at least one stand pivotally connected to a side opposite said indicia for contacting said respective side compartment when said second cover section is in an open position, thereby retaining said second cover section in a position parallel to said platform providing an extended work area for the user.

23. The ladder including storage areas as recited in claim 1, further comprising a paint tray and means for releasably connecting said paint tray in a work area of said ladder and easily accessible to a user.

24. The ladder including storage areas as recited in claim 23, wherein said paint tray includes at least one clip positioned on an underside of said paint tray for releasably connecting said paint tray to said ladder.

25. The ladder including storage areas as recited in claim 24, wherein said paint tray further includes means for receiving a paintbrush positioned on a side of said paint tray and retaining the paint brush in a position readily accessible to a user.

26. The ladder including storage areas as recited in claim 1, further comprising a work surface and means for releasably connecting said work surface in a work area of said ladder and easily accessible to a user.

27. The ladder including storage areas as recited in claim 26, wherein said work surface includes at least one clip positioned on an underside of said work surface for engaging said means for releasably connecting and releasably connecting said work surface to said ladder.

28. The ladder including storage areas as recited in claim 27, wherein said work surface further includes at least one retaining device adapted to receive a light bulb therein and retaining the light bulb in a position readily accessible to a user.

29. The ladder including storage areas as recited in claim 28, wherein said work surface further includes at least one recess adapted to receive a light bulb therein and retaining the light bulb in a position readily accessible to a user.

30. The ladder including storage areas as recited in claim 28, wherein said at least one retaining device is adapted to receive a fluorescent light bulb therein.

* * * * *